US009189957B2

(12) United States Patent
Nelson

(10) Patent No.: US 9,189,957 B2
(45) Date of Patent: Nov. 17, 2015

(54) SINGLE CYCLE OFFSET ADJUSTMENT FOR TRAFFIC SIGNAL CONTROLLERS USING A THRESHOLD PERCENTAGE OF THE CYCLE LENGTH

(71) Applicant: Daniel K. Nelson, Round Rock, TX (US)

(72) Inventor: Daniel K. Nelson, Round Rock, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 187 days.

(21) Appl. No.: 14/014,579

(22) Filed: Aug. 30, 2013

(65) Prior Publication Data

US 2015/0066340 A1 Mar. 5, 2015

(51) Int. Cl.

| | |
|---|---|
| ***G08B 21/00*** | (2006.01) |
| ***G08G 1/081*** | (2006.01) |
| ***G08G 1/095*** | (2006.01) |

(52) U.S. Cl.

CPC ..... *G08G 1/081* (2013.01); *G08G 1/095* (2013.01)

(58) Field of Classification Search

CPC ..... G08G 1/081; G08G 1/083; G08G 1/095
USPC ..... 340/907, 909, 913, 916, 918; 701/117
See application file for complete search history.

(56) References Cited

U.S. PATENT DOCUMENTS 4,061,903 A * 12/1977 Battle ..... 701/117

* cited by examiner

*Primary Examiner* — Jeffery Hofsass

(57) ABSTRACT

Embodiments include a method for single cycle offset adjustment for a traffic signal includes receiving a current signal control plan and a new signal control plan. The method also includes calculating an offset between the current signal control plan and a new signal control plan and determining if the offset is less than a threshold percentage of a cycle length of the new signal control plan. If the offset is less than a threshold percentage of the cycle length, the method includes reducing a time period of each phase of a next cycle of the new signal control plan. If the offset is greater than the threshold percentage of the cycle length, the method includes increasing the time period of each phase of the next cycle of the new signal control plan. The method also includes executing the new signal control plan.

20 Claims, 5 Drawing Sheets

SINGLE CYCLE OFFSET ADJUSTMENT FOR TRAFFIC SIGNAL CONTROLLERS USING A THRESHOLD PERCENTAGE OF THE CYCLE LENGTH

BACKGROUND

The present invention relates generally to a traffic management system and more specifically to, a single cycle offset adjustment for traffic signal controllers in a traffic management system.

In general, traffic management systems are utilized to control the operation of traffic signals along arterial roads. The goal of the traffic management system is to maximize vehicle throughput on the arterial road while minimizing delays. Traffic signal controllers are used to control the operation of traffic signals along the arterial roads and to adjust the signal phasing and timing based on the time and day of the week. In general, when a transition from one signal control plan to another occurs, the traffic signal controller resynchronizes the traffic signal settings by using an offset correction method.

Many currently available offset correction methods take several signal cycles to complete the offset correction and therefore the transition from one signal control plan to another may produce offset correction delays. This delay in transitioning to the new signal control plan is often counterproductive to the goal of implementing the new signal control plan. In addition, currently available offset correction methods often cause long delays by dwelling in a single phase for an extend period of time while transitioning from one signal control plan to another.

SUMMARY

According to one embodiment, a method for single cycle offset adjustment for a traffic signal includes receiving a current signal control plan and a new signal control plan. The method also includes calculating an offset between the current signal control plan and the new signal control plan and determining if the offset is less than a threshold percentage of a cycle length of the current signal control plan. Based on determining that the offset is less than a threshold percentage of the cycle length of the current signal control plan, the method includes reducing a time period of each phase of a next cycle of the current signal control plan. Based on determining that the offset is greater than or equal to the threshold percentage of the cycle length of the current signal control plan, the method includes increasing the time period of each phase of the next cycle of the current signal control plan.

According to another embodiment, a traffic signal controller includes a processor configured to operate a traffic signal, the processor configured to perform a method. The method includes receiving a current signal control plan and a new signal control plan, calculating an offset between the current signal control plan and the new signal control plan, and determining if the offset is less than a threshold percentage of a cycle length of the current signal control plan. Based on determining that the offset is less than a threshold percentage of the cycle length of the current signal control plan, the method includes reducing a time period of each phase of a next cycle of the current signal control plan. Based on determining that the offset is greater than or equal to the threshold percentage of the cycle length of the current signal control plan, the method includes increasing the time period of each phase of the next cycle of the current signal control plan. The method also includes executing the next cycle of the current signal control plan and executing the new signal control plan.

According to yet another embodiment, a computer program product for performing single cycle offset adjustment for a traffic signal is provided. The computer program product includes a tangible storage medium readable by a processing circuit and storing instructions for execution by the processing circuit for performing a method. The method includes executing a signal control plan having a cycle length, receiving a new signal control plan and calculating an offset between the signal control plan and the new signal control plan. The method also includes determining if the offset is less than a threshold percentage of the cycle length. Based on determining that the offset is less than a threshold percentage of the cycle length, the method includes reducing a time period of each phase of a next cycle of the signal control plan. Based on determining that the offset is greater than or equal to the threshold percentage of the cycle length, the method includes increasing the time period of each phase of the next cycle of the signal control plan. The method also includes executing the next cycle of the signal control plan and executing the new signal control plan.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
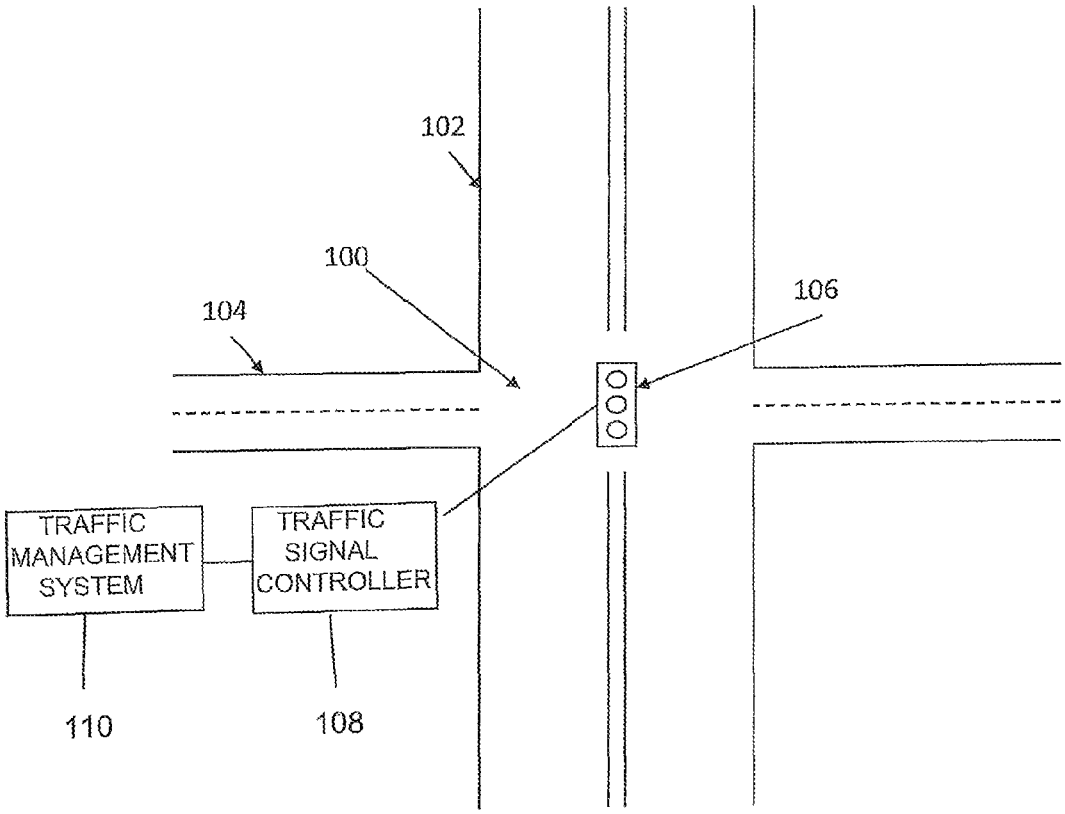
FIG. 1 is a schematic diagram illustrating an intersection in accordance with an exemplary embodiment.

Referring now to FIG. 1, a block diagram of an intersection 100 in accordance with an exemplary embodiment is shown. As illustrated, the intersection 100 includes a traffic signal 106 that is configured to control the traffic flow through the intersection 100, a main street 102 and a side street 104. In exemplary embodiments, the traffic signal 106 is controlled by a traffic signal controller 108, which may be a processing system, such as a computer having a processor, as generally known in the art. In exemplary embodiments, the traffic signal controller 108 is configured to communicate with a traffic management system 110.

In exemplary embodiments, the traffic management system 110 is configured to communicate with one or more traffic signal controllers 108. In exemplary embodiments, the management system 110 may be connected to the traffic signal controller 108 by a fiber optic cable, copper wire, or by other suitable means. The traffic signal controllers 108 are configured to communicate with the traffic management system 110 and to control one or more traffic signals 106. In exemplary embodiments, the traffic signal controller 108 may receive signal control plans from the traffic management system 110 which are used to govern the operation of the traffic signal 106 during different times of the day and days of the week.

Figure 2:
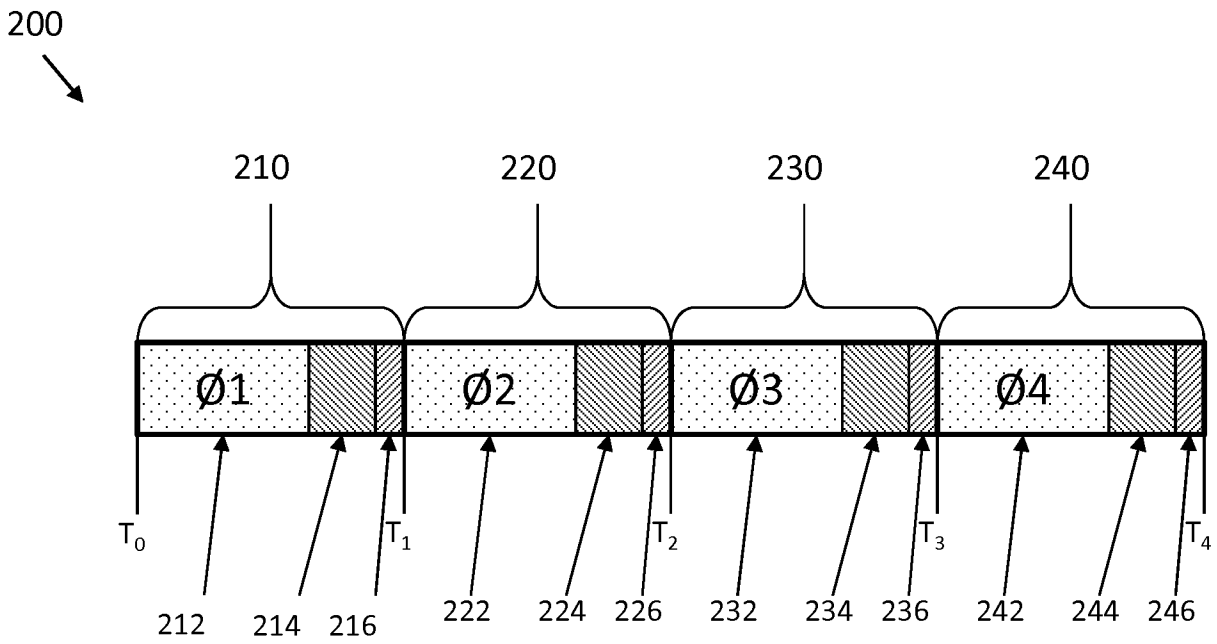
FIG. 2 is a block diagram illustrating a cycle of a traffic signal in accordance with an exemplary embodiment.

FIG. 2 a block diagram of a cycle 200 of a traffic signal in accordance with an exemplary embodiment is shown. As illustrated, the cycle 200 includes four phases of operation 210, 220, 230, 240. For example, the cycle 200 may include a first phase 210 that corresponds to a main street left turn traffic condition, a second phase 220 that corresponds to a main street through condition, a third phase 230 that corresponds to a side street left turn traffic condition, and a fourth phase 240 that corresponds to a side street through condition. As illustrated, the first phase 210, and the cycle 200, starts at time $T_0$, the second phase 220 starts at time $T_1$, the third phase 230 starts at time $T_2$, the fourth phase 240 starts at time $T_3$, the fourth phase 220, and the cycle 200, ends at time $T_4$ Accordingly, the period of the cycle, or cycle length, is defined as $T_4-T_0$.

Each phase 210, 220, 230, 240 includes three sub-phases that correspond to green light time 212, 222, 232, 242, yellow light time 214, 224, 234, 244, and red light time 216, 226, 236, 246. Although, the length of each phase 210, 220, 230, 240 is shown as approximately equal, it will be understood by those of ordinary skill in the art that the length of each phase 210, 220, 230, 240 may be different. Likewise, even though the green light time 212, 222, 232, 242 of each phase 210, 220, 230, 240 is shown as approximately equal, it will be understood by those of ordinary skill in the art that the green light time 212, 222, 232, 242 of each phase 210, 220, 230, 240 may be different.

In exemplary embodiments, the signal control plan received by the traffic signal controller includes a cycle for the traffic signal that is continually repeated. In exemplary embodiments, the traffic signal controller is configured to employ different signal control plans during different times of the day and on different days of the week. For example, during morning rush hour it may be desirable for a longer portion of the cycle to be devoted to one phase of the cycle than during lunch time. Accordingly, the traffic signal controller may be configured to switch between signal control plans multiple times during the day.

Figure 3:
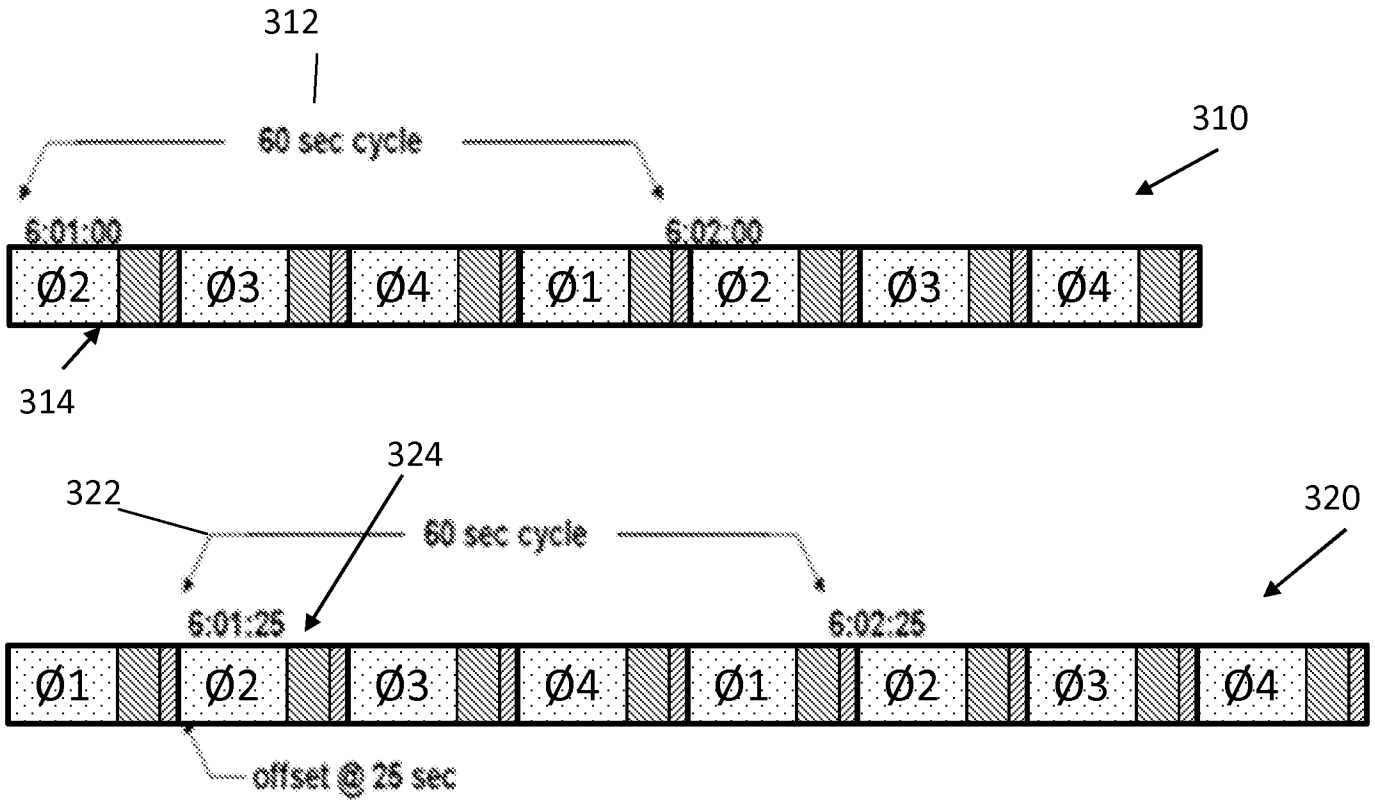
FIG. 3 is block diagrams illustrating signal control plans for a traffic signal in accordance with an exemplary embodiment.

Referring now to FIG. 3, block diagrams of a first signal control plan 310 and a second signal control plan 320 for operating a traffic signal in accordance with an exemplary embodiment are shown. As illustrated, the first signal control plan 310 includes a first cycle 312 that is repeated and the second signal control plan 320 includes a second cycle 322 that is repeated. In exemplary embodiments, the first cycle 312 and the second cycle 322 may have the same or different cycle lengths. In addition, the length of the various phases and sub-phases of the first cycle 312 and the second cycle 322 may also be different.

In exemplary embodiments, the offset of the two signal control plans 310, 320 is defined as the difference in the starting time of the same phase. For example, as illustrated the second phase 314 of the first signal control plan 310 begins at 6:01:00 and the second phase 324 of the second signal control plan 320 begins at 6:01:25. Accordingly, the offset between the first signal control plan 310 and the second signal control plan 320 is twenty-five seconds.

Figure 4:
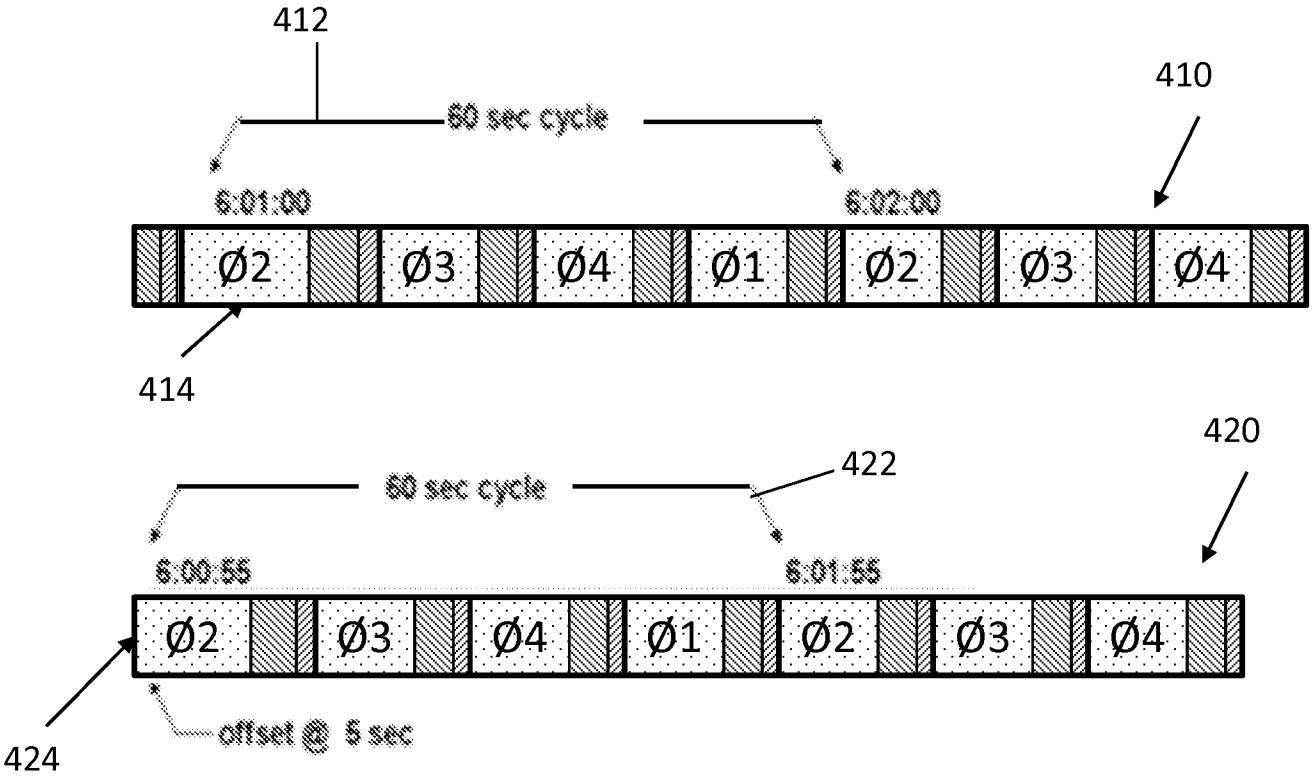
FIG. 4 is block diagrams illustrating signal control plans for a traffic signal in accordance with an exemplary embodiment.

Referring now to FIG. 4, block diagrams of a first signal control plan 410 and a second signal control plan 420 for operating a traffic signal in accordance with an exemplary embodiment are shown. As illustrated, the first signal control plan 410 includes a first cycle 412 that is repeated and the second signal control plan 420 includes a second cycle 422 that is repeated. In exemplary embodiments, the first cycle 412 and the second cycle 422 may have the same or different cycle lengths. In addition, the length of the various phases and sub-phases of the first cycle 412 and the second cycle 422 may also be different.

In exemplary embodiments, the offset of the two signal control plans 410, 422 is defined as the difference the staring time of the same phase. For example, as illustrated the second phase 414 of the first signal control plan 410 begins at 6:01:00 and the second phase 424 of the second signal control plan 420 begins at 6:00:55. Accordingly, the offset between the first signal control plan 410 and the second signal control plan 420 is five seconds.

Figure 5:
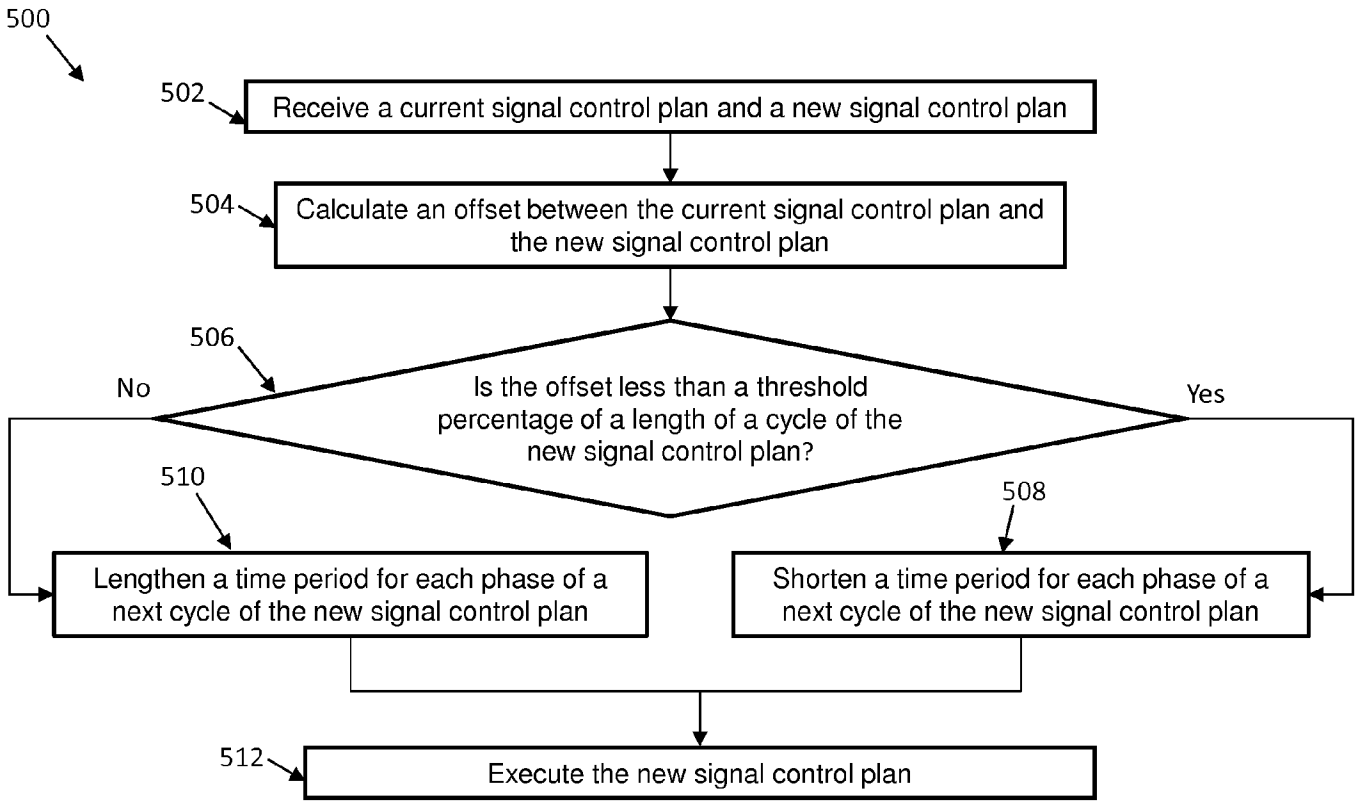
FIG. 5 is a flow chart diagram illustrating a method for performing a single cycle offset adjustment of a traffic signal in accordance with an exemplary embodiment.

Referring now to FIG. 5, a flow chart diagram of a method 500 for performing a single cycle offset adjustment of a traffic signal in accordance with an exemplary embodiment is shown. As illustrated at block 502, the method 500 includes receiving a current signal control plan and a new signal control plan. Next, as shown at block 504, the method 500 includes calculating an offset between the current signal control plan and the new signal control plan. Next, as shown at decision block 506, the method 500 includes determining if the offset is less than a threshold percentage of a cycle length of the new signal control plan. In one embodiment, the threshold percentage is fifteen percent. In exemplary embodiments, the offset is calculated as the difference in the staring times of the same phase between the current signal control plan and the new signal control plan.

Continuing with reference to FIG. 5, if the offset is less than the threshold percentage of the cycle length of the current signal control plan, the method 500 proceeds to block 508 and shortens a time period for each phase of a next cycle of the new signal control plan. In exemplary embodiment, the time period for each phase of the next cycle of the new signal control plan are each proportionally shortened by amount of time based on the portion of the cycle length each phase is allocated.

In one embodiment, the new signal control plan has a sixty second cycle length and includes four phases. The first and second phases have a period of twenty seconds and the third and forth phases have a period of ten seconds. The offset between the current signal control plan and the new control plan is calculated to be six seconds, which corresponds to ten percent of the cycle length and the threshold percentage is fifteen percent. Since the offset is less than the threshold percentage, each of the periods of the next cycle of the new signal control plan will be reduced to adjust for the six second offset. Accordingly, during the next cycle of the new signal control plan the first and second phases will have a period of eighteen seconds and the third and forth phases will have a period of nine seconds.

In another embodiment, reducing the time period for each phase of the next cycle of the new signal control plan will be achieved by reducing the length of only one sub-phase of each phase. For example, only the green light sub-phase may be reduced.

If the offset is greater than or equal to the threshold percentage of the cycle length of the new signal control plan, the method 500 proceeds to block 508 and lengthens a time period for each phase of a next cycle of the new signal control plan. In exemplary embodiment, the time period for each phase of the next cycle of the current signal control plan are each proportionally lengthened by amount of time based on the portion of the cycle length each phase is allocated.

In one embodiment, the new signal control plan has a sixty second cycle length and includes four phases. The first and second phases have a period of twenty seconds and the third and forth phases have a period of ten seconds. The offset between the current signal control plan and the new control plan is calculated to be twelve seconds, which corresponds to twenty percent of the cycle length and the threshold percentage is fifteen percent. Since the offset is greater than the threshold percentage, each of the periods of the next cycle of the new signal control plan will be increased to adjust for the twelve second offset. Accordingly, during the next cycle of the new signal control plan the first and second phases will have a period of twenty-four seconds and the third and forth phases will have a period of twelve seconds.

In another embodiment, increasing the time period for each phase of the next cycle of the new signal control plan may be achieved by increasing the length of only one sub-phase of each phase. For example, only the green light sup-phase may be increased.

Continuing with reference to FIG. 5, as shown at block 512, the method 500 includes executing the new signal control plan. In exemplary embodiments, the transition to the new signal control plan from the current signal control plan is completed in a single cycle.

In exemplary embodiments, the method for single cycle offset adjustment for a traffic signal may be configured to work with traffic signal controller that utilize either fixed or floating force-off points.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method for performing a single cycle offset adjustment of a traffic signal comprising:

receiving a current signal control plan and a new signal control plan;

calculating an offset between the current signal control plan and the new signal control plan;

determining if the offset is less than a threshold percentage of a cycle length of the new signal control plan;

based on determining that the offset is less than the threshold percentage of the cycle length of the new signal control plan, reducing a time period of each phase of a next cycle of the new signal control plan;

based on determining that the offset is greater than or equal to the threshold percentage of the cycle length of the new signal control plan, increasing the time period of each phase of the next cycle of the new signal control plan; and executing the new signal control plan.

2. The method of claim 1, further comprising executing the new signal control plan after the current signal control plan has been executed.

3. The method of claim 1, wherein reducing the time period of each phase of a next cycle of the new signal control plan comprises proportionally reducing the time period of each phase of the next cycle of the new signal control plan based on a percentage of the cycle length assigned to each phase.

4. The method of claim 1, wherein increasing the time period of each phase of a next cycle of the new signal control plan comprises proportionally increasing the time period of each phase of the next cycle of the new signal control plan based on a percentage of the cycle length assigned to each phase.

5. The method of claim 1, wherein the threshold percentage is fifteen percent.

6. The method of claim 1, wherein the offset is calculated as the difference in a staring time of a first phase of the current signal control plan and a first phase of the new signal control plan.

7. The method of claim 6, wherein the first phase of the current signal control plan and the first phase of the new signal control plan both correspond to an identical traffic condition.

8. The method of claim 1, wherein the current signal control plan comprises four phases including a main street left turn phase, a main street through phase, a side street left turn phase, and a side street through phase.

9. The method of claim 1, wherein the new signal control plan comprises four phases including a main street left turn phase, a main street through phase, a side street left turn phase, and a side street through phase.

10. A traffic signal controller comprising:

a processor configured to operate a traffic signal, the processor configured to perform a method comprising:

receiving a current signal control plan and a new signal control plan;

calculating an offset between the current signal control plan and the new signal control plan;

determining if the offset is less than a threshold percentage of a cycle length of the new signal control plan;

based on determining that the offset is less than a threshold percentage of the cycle length of the new signal control plan, reducing a time period of each phase of a next cycle of the current signal control plan;

based on determining that the offset is greater than or equal to the threshold percentage of the cycle length of the new signal control plan, increasing the time period of each phase of the next cycle of the new signal control plan;

executing the new signal control plan.

11. The traffic signal controller of claim 10, wherein the current signal control plan and the new signal control plan are received from a traffic management system.

12. The traffic signal controller of claim 10, wherein reducing the time period of each phase of a next cycle of the new signal control plan comprises proportionally reducing the time period of each phase of the next cycle of the new signal control plan based on a percentage of the cycle length assigned to each phase.

13. The traffic signal controller of claim 10, wherein increasing the time period of each phase of a next cycle of the new signal control plan comprises proportionally increasing the time period of each phase of the next cycle of the new signal control plan based on a percentage of the cycle length assigned to each phase.

14. The traffic signal controller of claim 10, wherein the threshold percentage is fifteen percent.

15. The traffic signal controller of claim 10, wherein the offset is calculated as the difference in a staring time of a first phase of the current signal control plan and a first phase of the new signal control plan.

16. The traffic signal controller of claim 15, wherein the first phase of the current signal control plan and the first phase of the new signal control plan both correspond to an identical traffic condition.

17. The traffic signal controller of claim 10, wherein the current signal control plan comprises four phases including a main street left turn phase, a main street through phase, a side street left turn phase, and a side street through phase.

18. The traffic signal controller of claim 10, wherein the new signal control plan comprises four phases including a main street left turn phase, a main street through phase, a side street left turn phase, and a side street through phase.

19. The traffic signal controller of claim 10, further comprising a memory for storing the current signal control plan and the new signal control plan.

20. A computer program product for performing single cycle offset adjustment for a traffic signal, the computer program product comprising:

a tangible storage medium readable by a processing circuit and storing instructions for execution by the processing circuit for performing a method comprising:

executing a signal control plan having a cycle length;

receiving a new signal control plan;

calculating an offset between the signal control plan and the new signal control plan;

determining if the offset is less than a threshold percentage of the cycle length;

based on determining that the offset is less than a threshold percentage of the cycle length, reducing a time period of each phase of a next cycle of the new signal control plan;

based on determining that the offset is greater than or equal to the threshold percentage of the cycle length, increasing the time period of each phase of the next cycle of the new signal control plan;

executing the new signal control plan.

* * * * *